US008936446B2

(12) United States Patent
Wang

(10) Patent No.: US 8,936,446 B2
(45) Date of Patent: Jan. 20, 2015

(54) SLIDING INFLATOR WITH INNER AND OUTER CYLINDERS

(71) Applicant: Beto Engineering and Marketing Co., Ltd, Taichung (TW)

(72) Inventor: Lopin Wang, Taiching (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 251 days.

(21) Appl. No.: 13/731,990

(22) Filed: Dec. 31, 2012

(65) Prior Publication Data

US 2013/0183180 A1 Jul. 18, 2013

(30) Foreign Application Priority Data

Jan. 17, 2012 (TW) ..... 101101808 A

(51) Int. Cl.
*F04B 33/00* (2006.01)

(52) U.S. Cl.
CPC ..... *F04B 33/00* (2013.01); *F04B 33/005* (2013.01)
USPC ..... 417/437

(58) Field of Classification Search
CPC ..... F04B 33/00
USPC ..... 417/437, 234, 265, 313, 460
See application file for complete search history.

(56) References Cited

U.S. PATENT DOCUMENTS

| | | | | | |
|---|---|---|---|---|---|
| 4,569,275 | A * | 2/1986 | Brunet | 92/58.1 |
| 5,165,876 | A * | 11/1992 | Wang | 417/511 |
| 5,443,370 | A | 8/1995 | Wang | |
| 6,135,733 | A | 10/2000 | Wu | |
| 6,325,601 | B2 * | 12/2001 | Wu | 417/469 |
| 6,615,704 | B2 * | 9/2003 | Chuang | 92/58.1 |
| 7,762,797 | B2 * | 7/2010 | Wu | 417/572 |
| 8,025,491 | B2 * | 9/2011 | Wang | 417/468 |
| 2006/0198745 | A1 * | 9/2006 | Huang | 417/521 |

* cited by examiner

*Primary Examiner* — Devon Kramer
*Assistant Examiner* — Nathan Zollinger
(74) *Attorney, Agent, or Firm* — Muncy, Geissler, Olds & Lowe, P.C.

(57) ABSTRACT

A sliding inflator with inner and outer cylinders is provided. The outer cylinder has a fixing element with an axial pipe protruding therefrom and having two through holes. A rotating element is disposed around the axial pipe and has two receiving chambers matching the through holes, respectively, and receiving a ball each. A gradually-deepened curved portion of the receiving chamber is defined between shallow and deep ends thereof. The rotating element rotates between an unlocked position and a locked position. A stopping element is fixed to the inner cylinder and has a protruding post with an annular groove. The rotating element switches from the unlocked position to the locked position to couple the cylinders together, and switches from the locked position to the unlocked position to release engagement between the cylinders.

5 Claims, 10 Drawing Sheets

SLIDING INFLATOR WITH INNER AND OUTER CYLINDERS

BACKGROUND OF THE INVENTION

1. Technical Field

The present invention relates to inflators, and more particularly, to a sliding inflator with inner and outer cylinders.

2. Description of Related Art

U.S. Pat. No. 5,443,370, entitled Inflator Selectively Capable of Quick Inflation or High-pressure Inflation, discloses a sliding inflator with inner and outer cylinders, wherein the inner cylinder and the outer cylinder operate concurrently to effectuate quick inflation. U.S. Pat. No. 5,443,370 further discloses that the inner cylinder and the outer cylinder are fastened together to thereby function as a unitary structure, such that the outer cylinder does not move, but the inner cylinder effectuates inflation and saves manpower, thereby effectuating high-pressure inflation.

U.S. Pat. No. 6,135,733, entitled Inflator Capable of Changing Operation Mode, also discloses an inflator with inner and outer cylinders, wherein the inner cylinder is selectively fastened to a handle or the outer cylinder to thereby effectuate quick inflation or high-pressure inflation.

BRIEF SUMMARY OF THE INVENTION

It is an objective of the present invention to provide a sliding inflator with inner and outer cylinders, characterized by a novel fastening structure of the inner and outer cylinders.

In order to achieve the above and other objectives, the present invention provides a sliding inflator with inner and outer cylinders, comprising: an outer cylinder; a nozzle connector disposed at an end of the outer cylinder; an inner cylinder inserted into the outer cylinder from another end thereof and slidable relative to the outer cylinder; a piston disposed in the inner cylinder; a piston rod having an end fixed to the piston and another end protruding from the inner cylinder; a handle disposed at the exposed end of the piston rod; a fixing element disposed at an inner end of the nozzle connector disposed at the outer cylinder and extending in a direction of the inner cylinder to form an axial pipe having at least a through hole; a rotating element disposed around the axial pipe, being rotatable clockwise and anticlockwise within a predetermined range of angles, and having a receiving chamber corresponding in position to each of the at least a through hole of the axial pipe, wherein a gradually-deepened curved portion of the receiving chamber is defined between a shallow end of the receiving chamber and a deep end of the receiving chamber, each said receiving chamber receiving a ball; and a stopping element fixed to an inner end of the inner cylinder and extending in a direction of the fixing element to form a protruding post having an annular groove, wherein the rotating element rotates clockwise and anticlockwise between an unlocked position and a locked position, the unlocked position being one at which the deep end of the receiving chamber corresponds in position to the through hole, and the locked position being one at which the shallow end of the receiving chamber corresponds in position to the through hole, wherein, when in the locked position, the ball is compressed and forced to penetrate the through hole and thereby be partially inserted into an axial hole of the axial pipe, wherein, when in the unlocked position, the ball exits the axial hole of the axial pipe to thereby be received at the deep end of the receiving chamber, wherein, as soon as the inner cylinder retreats to reach an innermost end of the outer cylinder, the protruding post of the stopping element is inserted into the axial hole of the axial pipe of the fixing element, wherein, as soon as the inner cylinder is rotated, the stopping element drives the rotating element to rotate, wherein, as soon as the rotating element switches from the unlocked position to the locked position, the ball is forced to protrude from the axial hole and thereby engage with an annular groove of the protruding post, such that the inner cylinder and the outer cylinder are engaged with and fixed to each other integrally, wherein, as soon as the rotating element switches from the locked position to the unlocked position, the ball exits the axial hole to thereby release the inner cylinder and the outer cylinder from engagement with each other.

BRIEF DESCRIPTION OF THE SEVERAL VIEWS OF THE DRAWINGS

Objectives, features, and advantages of the present invention are hereunder illustrated with an embodiment in conjunction with the accompanying drawings, in which:

FIG. 3 is a perspective view of the fixing element;

FIG. 4 is a front view of the fixing element;

FIG. 5 is a lateral view of the fixing element;

FIG. 6 is a top view of the fixing element;

FIG. 7 is a cross-sectional view of the fixing element taken along line 7-7 in FIG. 4;

DETAILED DESCRIPTION OF THE INVENTION

Figure 1:
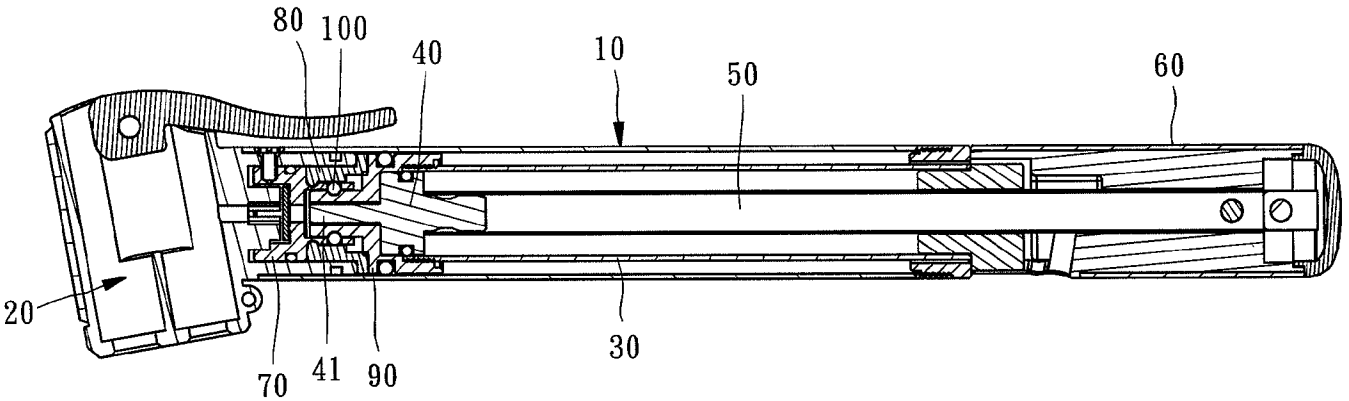
FIG. 1 is a cross-sectional view of a sliding inflator with inner and outer cylinders according to an embodiment of the present invention, wherein a locked position LOCK is shown.
Figure 2:
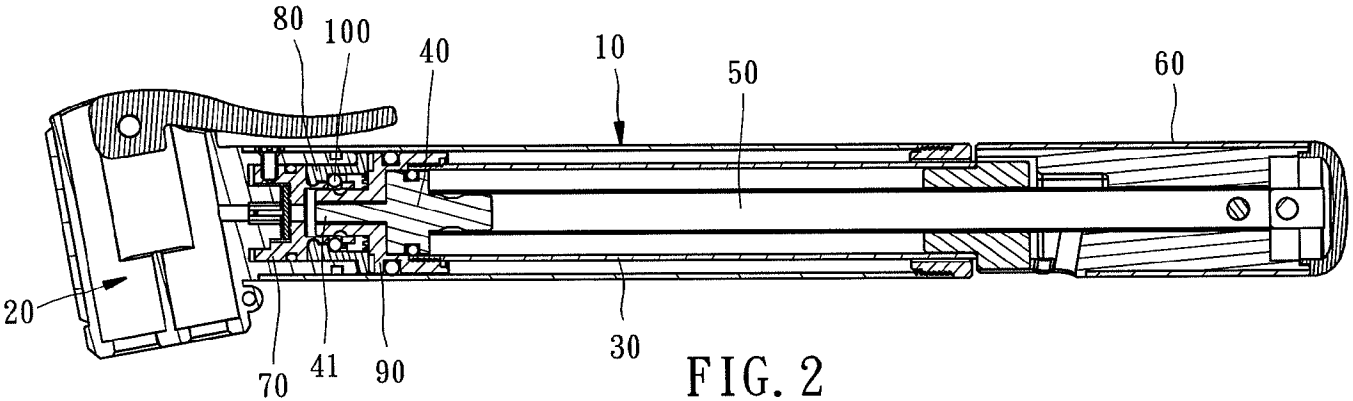
FIG. 2 is a cross-sectional view of the sliding inflator with inner and outer cylinders according to the embodiment of the present invention, wherein an unlocked position UNLOCK is shown.
Figure 3:
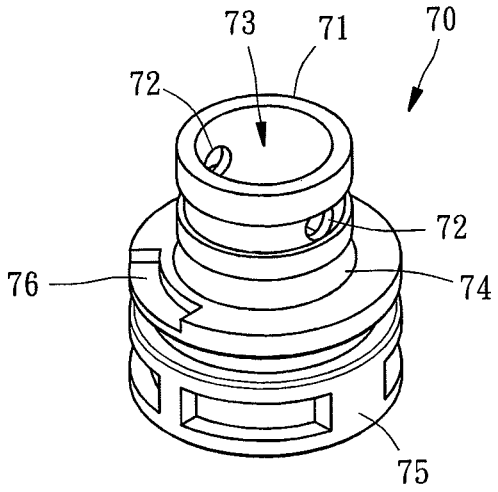
FIG. 3 through FIG. 7 are various diagrams of a fixing element according to the embodiment of the present invention.
Figure 4:
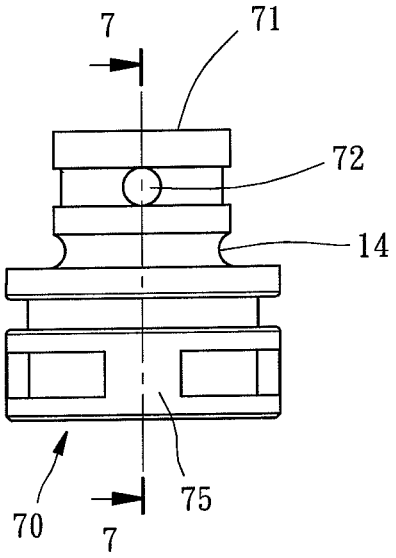
Figure 5:
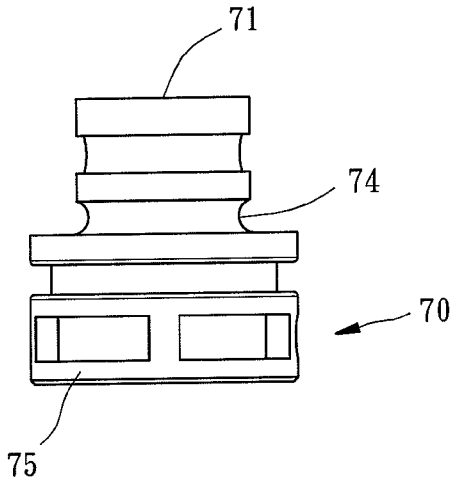
Figure 6:
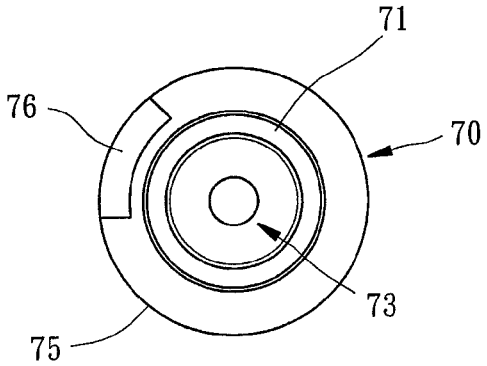
Figure 7:
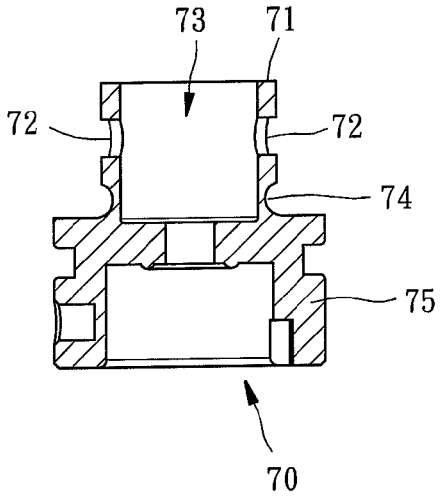
Figure 8:
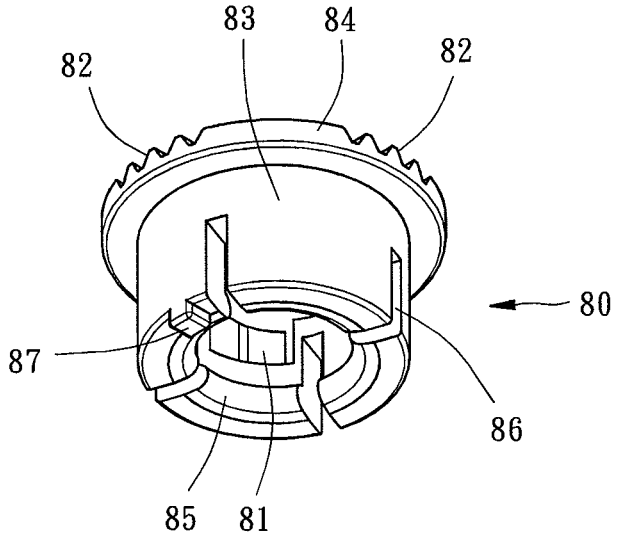
FIG. 8 is a perspective view of a rotating element according to the embodiment of the present invention.
Figure 9:
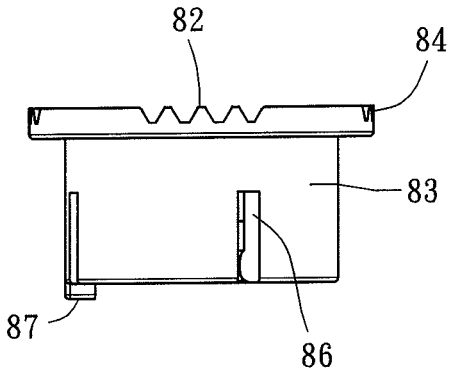
FIG. 9 is a front view of the rotating element.
Figure 10:
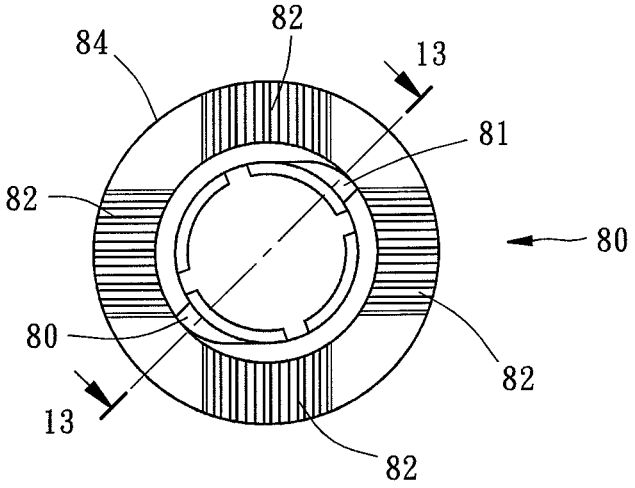
FIG. 10 is a top view of the rotating element.
Figure 11:
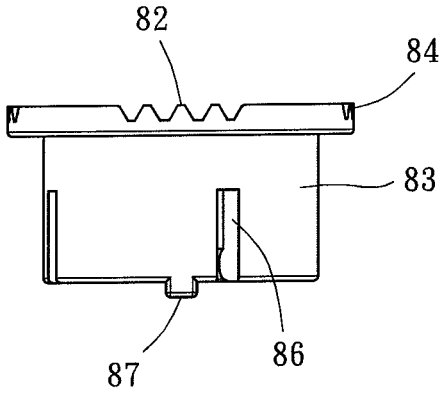
FIG. 11 is a lateral view of the rotating element.
Figure 12:
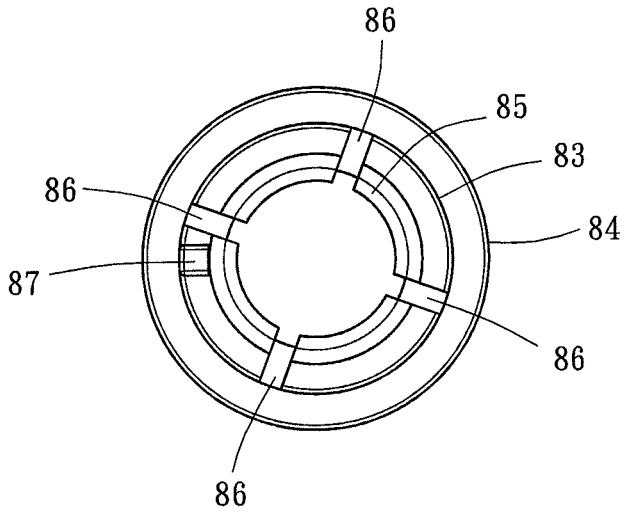
FIG. 12 is a bottom view of the rotating element.
Figure 13:
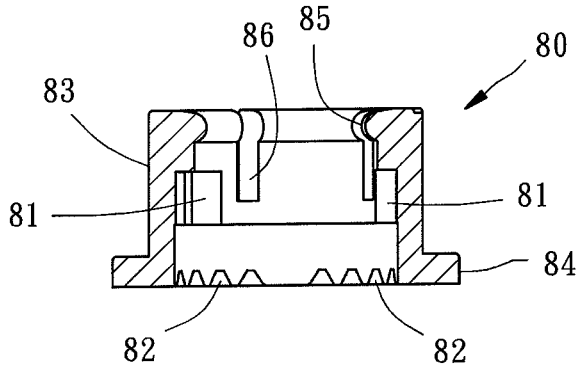
FIG. 13 is a cross-sectional view of the rotating element taken along line 13-13 in FIG. 10.
Figure 14:
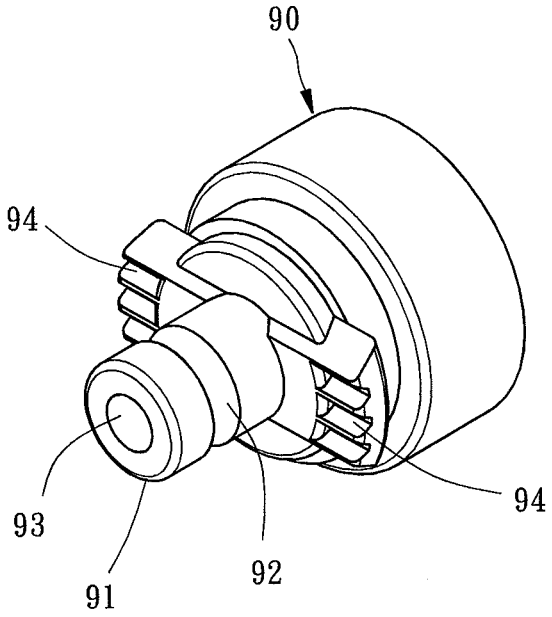
FIG. 14 is a perspective view of a stopping element according to the embodiment of the present invention.
Figure 15:
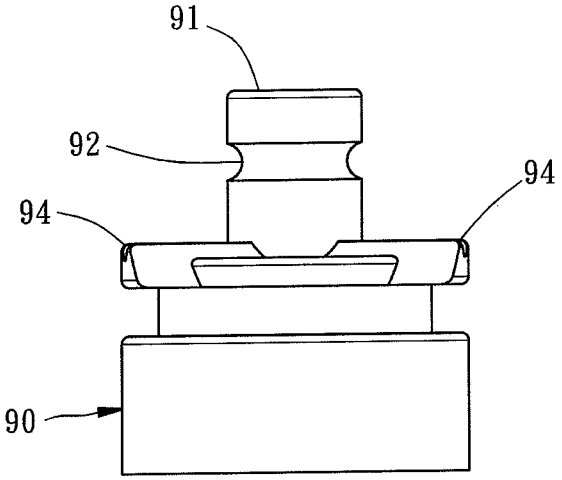
FIG. 15 is a front view of the stopping element.
Figure 16:
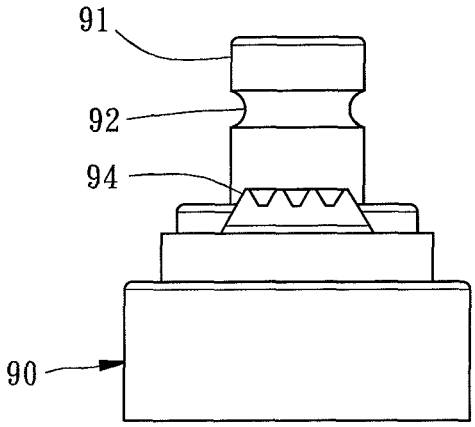
FIG. 16 is a lateral view of the stopping element.
Figure 17:
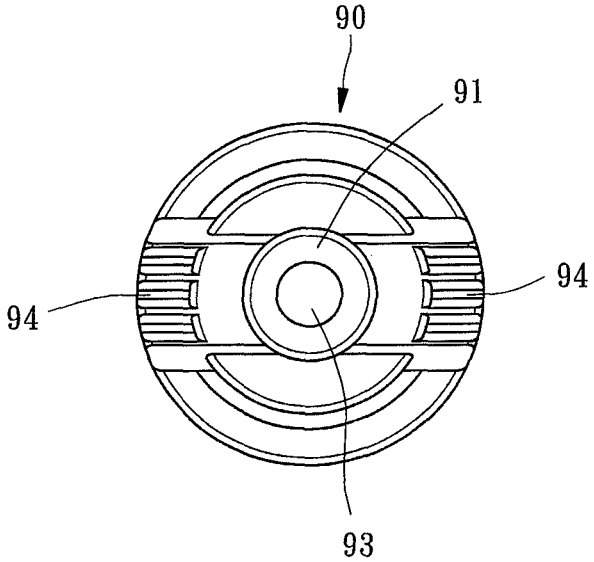
FIG. 17 is a top view of the stopping element.

Referring to FIG. 1 and FIG. 2, in an embodiment of the present invention, a sliding inflator with inner and outer cylinders comprises: an outer cylinder 10; a nozzle connector 20 disposed at one end of the outer cylinder 10 and connectable to an inflating valve of an object to be inflated; an inner cylinder 30 inserted into the outer cylinder 10 from the other end thereof and slidable relative to the outer cylinder 10; a piston 40 disposed in the inner cylinder 30; a piston rod 50 having one end fixed to the piston 40 and the other end protruding from the inner cylinder 30; and a handle 60 disposed at the exposed end of the piston rod 50.

Figure 18:
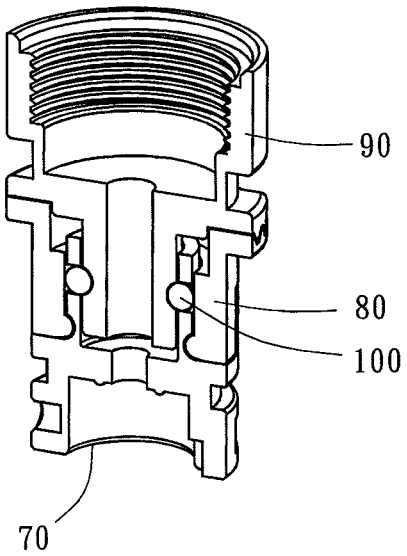
FIG. 18 is a cutaway view of the fixing element, the rotating element, the stopping element, and a ball which are put together and operating in the locked position LOCK.
Figure 19:
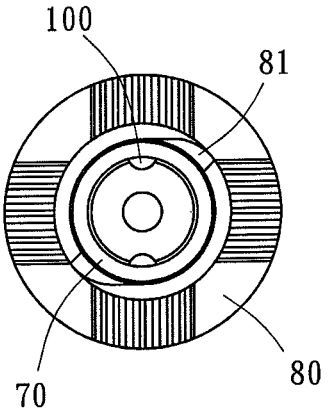
FIG. 19 is a top view of the fixing element, the rotating element, and the ball which are put together and operating in the locked position LOCK.
Figure 20:
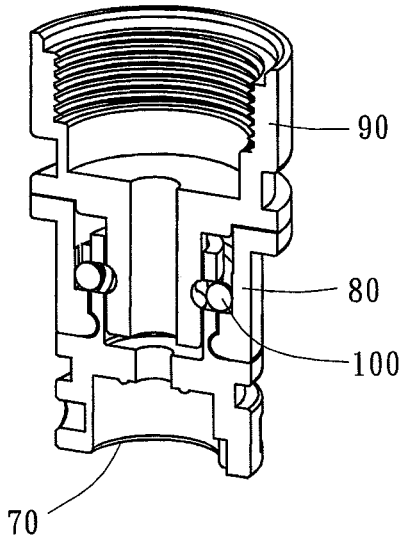
FIG. 20 is a cutaway view of the fixing element, the rotating element, the stopping element, and the ball which are put together and operating in the unlocked position UNLOCK.
Figure 21:
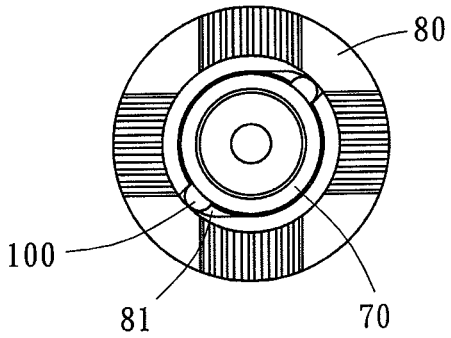
FIG. 21 is a top view of the fixing element, the rotating element, and the ball which are put together and operating in the unlocked position UNLOCK.

Referring to FIG. 3 through FIG. 7, a fixing element 70 is disposed at the inner end of the nozzle connector 20 disposed at one end of the outer cylinder 10. The fixing element 70 extends in the direction of the inner cylinder 10 to form an axial pipe 71. The axial pipe 71 has two through holes 72 running radially. Referring to FIG. 8 through FIG. 13, a rotating element 80 is disposed around the axial pipe 71 of the fixing element 70 and is rotatable about the axial pipe 71 clockwise and anticlockwise within a predetermined range of angles. The rotating element 80 has two receiving chambers 81 corresponding in position to the two through holes 72 of the axial pipe 71, respectively. A gradually-deepened curved portion of each said receiving chamber 81 is defined between a shallow end of the receiving chamber 81 and a deep end of the receiving chamber 81. The receiving chambers 81 each receive therein a ball 100. The rotating element 80 rotates clockwise and anticlockwise between an unlocked position UNLOCK and a locked position LOCK. The unlocked position UNLOCK is shown in FIG. 2, FIG. 20, and FIG. 21 and defined as one at which the deep end of the receiving chamber 81 corresponds in position to a corresponding one of the through holes 72. The locked position LOCK is shown in FIG. 1, FIG. 18, and FIG. 19 and defined as one at which the shallow end of the receiving chamber 81 corresponds in position to a corresponding one of the through holes 72. When in the locked position LOCK, the ball 100 is compressed and thus forced to penetrate a corresponding one of the through holes 72 and thereby be partially inserted into an axial hole 73 of the axial pipe 71. When in the unlocked position UNLOCK, the ball 100 exits the axial hole 73 of the axial pipe 71 to thereby be received at the deep end of the receiving chamber 81. Referring to FIG. 14 through FIG. 17, a stopping element 90 is fixed to the inner end of the inner cylinder 30 and extends in the direction of the fixing element 70 to form a protruding post 91. The protruding post 91 has an annular groove 92. As soon as the inner cylinder 30 retreats to reach the innermost end of the outer cylinder 10, the protruding post 91 of the stopping element 90 is inserted into the axial hole 73 of the axial pipe 71 of the fixing element 70. As soon as the inner cylinder 30 is rotated, the stopping element 90 drives the rotating element 80 to rotate. As soon as the rotating element 80 switches from the unlocked position UNLOCK to the locked position LOCK, the ball 100 is forced to protrude from the axial hole 73 and thereby engage with the annular groove 92 of the protruding post 91, such that the inner cylinder 10 and the outer cylinder 30 are engaged with and fixed to each other integrally as shown in FIG. 1. As soon as the rotating element 80 switches from the locked position LOCK to the unlocked position UNLOCK, the ball 100 exits the axial hole 73 to thereby release the inner cylinder 10 and the outer cylinder 30 from engagement with each other as shown in FIG. 2.

The protruding post 91 of the stopping element 90 has a penetrating hole 93 running axially. The penetrating hole 93 enables communication between the inner cylinder 30 and the outer cylinder 10. The piston 40 extends to form a protruding rod 41 corresponding in position to the penetrating hole 93. The protruding rod 41 is insertable into the penetrating hole 93. Hence, the piston 40 is effective in performing its inflation function thoroughly without causing a waste of space.

Two engaging portions 94 running radially are disposed at a bottom portion of the protruding post 91 of the stopping element 90. Four engaging portions 82 are disposed at an end surface of the rotating element 80. The two engaging portions 94 of the stopping element 90 are engaged with the four engaging portions 82 of the rotating element 80 to drive the rotation thereof. The aforesaid two or four engaging portions merely serve to illustrate a design choice and thus can be replaced by any other alternative choices. The purpose of the engaging portions 94, 82 is to render it easy for the stopping element 90 to drive the rotating element 80 to rotate.

An annular guiding groove 74 is disposed at a bottom portion of the axial pipe 71 of the fixing element 70. The rotating element 80 has a tubular body portion 83. An end of the body portion 83 extends radially and outwardly to form a shoulder portion 84. The other end of the body portion 83 extends radially and inwardly to form a snap-engagement portion 85. A predetermined number of notches 86 running in the direction from the snap-engagement portion 85 to the shoulder portion 84 are disposed at the body portion 83. In this embodiment, the notches 86 are in the number of four. The body portion 83 of the rotating element 80 is disposed around the axial pipe 71 of the fixing element 70. The snap-engagement portion 85 of the rotating element 80 is snap-engaged with the annular guiding groove 74 of the fixing element 70, such that the rotating element 80 can rotate about the axial pipe 71 of the fixing element 70. The engaging portions 82 are disposed on the shoulder portion 84.

The fixing element 70 has an end portion 75. The axial pipe 71 is disposed centrally at the end portion 75. A curved guiding groove 76 is disposed on an end surface of the end portion 75, wherein the end surface of the end portion 75 faces the axial pipe 71. A bump 87 is disposed on an end surface of the rotating element 80, wherein the end surface of the rotating element 80 faces the end portion 75. The bump 87 can be exactly received by the curved guiding groove 76. As soon as the rotating element 80 rotates clockwise and anticlockwise, the bump 87 is stopped by the groove walls at the two ends of the curved guiding groove 76 to thereby form the locked position LOCK and the unlocked position UNLOCK.

The present invention is characterized in that the stopping element 90 rotates the rotating element 80 to drive the two balls 100 to enter a locked position and thus arrest the motion of the stopping element 90, and that the rotating element 80 rotates anticlockwise to allow the two balls 100 to exit the locked position and thus create an unlocked state. Accordingly, the sliding inflator with inner and outer cylinders of the present invention has a novel structure and is easy to use, durable, and practical.

What is claimed is:

1. A sliding inflator with inner and outer cylinders, comprising:

an outer cylinder;

a nozzle connector disposed at an end of the outer cylinder;

an inner cylinder inserted into the outer cylinder from another end thereof and slidable relative to the outer cylinder;

a piston disposed in the inner cylinder;

a piston rod having an end fixed to the piston and another end protruding from the inner cylinder;

a handle disposed at the end of the piston rod opposite the piston;

a fixing element disposed at an inner end of the nozzle connector disposed at the outer cylinder and extending in a direction of the inner cylinder to form an axial pipe having at least a through hole running radially;

a rotating element disposed around the axial pipe, being rotatable clockwise and anticlockwise within a predetermined range of angles, and having a receiving chamber corresponding in position to each through hole of the axial pipe, wherein a gradually-deepened curved portion of the receiving chamber is defined between a shallow end of the receiving chamber and a deep end of the receiving chamber, each receiving chamber receiving a ball; and a stopping element fixed to an inner end of the inner cylinder and extending in a direction of the fixing element to form a protruding post having an annular groove, wherein the rotating element rotates clockwise and anticlockwise between an unlocked position and a locked position, the unlocked position being one at which the deep end of each receiving chamber corresponds in position to its respective through hole, and the locked position being one at which the shallow end of each receiving chamber corresponds in position to its respective through hole, wherein, when in the locked position, the ball is compressed and forced to penetrate its respective through hole and thereby be partially inserted into an axial hole of the axial pipe, wherein, when in the unlocked position, the ball exits the axial hole of the axial pipe to thereby be received at the deep end of its respective receiving chamber, wherein, as soon as the inner cylinder retreats to reach the end of the outer cylinder adjacent the nozzle connector, the protruding post of the stopping element is inserted into the axial hole of the axial pipe of the fixing element, wherein, as soon as the inner cylinder is rotated, the stopping element drives the rotating element to rotate, wherein, as soon as the rotating element switches from the unlocked position to the locked position, the ball is forced to protrude from the axial hole and thereby engage with an annular groove of the protruding post, such that the inner cylinder and the outer cylinder are engaged with and fixed to each other integrally, wherein, as soon as the rotating element switches from the locked position to the unlocked position, the ball exits the axial hole to thereby release the inner cylinder and the outer cylinder from engagement with each other.

2. The inflator of claim 1, wherein the protruding post of the stopping element has a penetrating hole running axially and enabling communication between the inner cylinder and the outer cylinder, wherein the piston extends to form a protruding rod corresponding in position to the penetrating hole and being insertable into the penetrating hole.

3. The inflator of claim 1, wherein two engaging portions running radially are disposed at a bottom portion of the protruding post of the stopping element, and four engaging portions are disposed at an end surface of the rotating element, thereby allowing the two engaging portions of the stopping element to be engaged with the four engaging portions of the rotating element to drive the rotation thereof.

4. The inflator of claim 1, wherein an annular guiding groove is disposed at a bottom portion of the axial pipe of the fixing element, wherein the rotating element has a tubular body portion, wherein an end of the body portion extends radially and outwardly to form a shoulder portion, wherein another end of the body portion extends radially and inwardly to form a snap-engagement portion, wherein a predetermined number of notches running in the direction from the snap-engagement portion to the shoulder portion are disposed at the body portion, wherein the body portion of the rotating element is disposed around the axial pipe of the fixing element, and the snap-engagement portion is snap-engaged with a guiding groove of the fixing element, such that the rotating element can rotate about the axial pipe of the fixing element.

5. The inflator of claim 1, wherein the fixing element has an end portion, and the axial pipe is disposed centrally at the end portion, wherein a curved guiding groove is disposed on an end surface of the end portion, wherein the end surface of the end portion faces the axial pipe, wherein a bump is disposed on an end surface of the rotating element, wherein the end surface of the rotating element faces the end portion, such that the bump can be exactly received by the curved guiding groove, wherein, as soon as the rotating element rotates clockwise and anticlockwise, the bump is stopped by groove walls at two ends of the curved guiding groove to thereby form the locked position and the unlocked position.

* * * * *